US005154519A

United States Patent [19]

Kodama

[11] Patent Number: 5,154,519

[45] Date of Patent: Oct. 13, 1992

[54] PAPER BAIL DEVICE INCLUDING A REVERSIBLE MOTOR TO DRIVE THE PAPER BAIL AND A RIBBON

[75] Inventor: Hidetoshi Kodama, Tokyo, Japan

[73] Assignee: Seikosha Co., Ltd., Tokyo, Japan

[21] Appl. No.: 734,833

[22] Filed: Jul. 24, 1991

[30] Foreign Application Priority Data

Jul. 24, 1990 [JP] Japan ..... 2-195883

[51] Int. Cl.[5] ..... B41J 23/34

[52] U.S. Cl. ..... 400/185; 400/225; 400/639.1; 400/639.2

[58] Field of Search ..... 400/185, 225, 187, 639–639.1, 400/636.2, 636, 636.1, 636.3

[56] References Cited

U.S. PATENT DOCUMENTS 3,519,117 7/1970 Smith ..... 400/636.2
4,031,995 6/1977 Blum et al. ..... 400/636.2
4,581,618 4/1986 Watanabe et al. ..... 400/185
4,602,883 7/1986 Ozawa et al. ..... 400/639.2 X
4,714,364 12/1987 Takada ..... 400/639.1
4,883,375 11/1989 Karube et al. ..... 400/639 X
4,971,469 11/1990 Nakajima ..... 400/636.1

*Primary Examiner*—Edgar S. Burr
*Assistant Examiner*—Christopher A. Bennett
*Attorney, Agent, or Firm*—Jordan and Hamburg

[57] ABSTRACT

A paper bail device includes a ribbon drive gear adapted to be driven by a reversible motor; a ribbon drive shaft coupled to the ribbon drive gear through a one-way clutch; a paper bail support lever hinged to a printer body and supporting a paper bail rotatably for bringing the paper bail into and out of contact with a platen; and a paper bail drive actuated by the power of the motor for driving the paper bail support lever to bring the paper bail into and out of contact with the platen.

16 Claims, 5 Drawing Sheets

PAPER BAIL DEVICE INCLUDING A REVERSIBLE MOTOR TO DRIVE THE PAPER BAIL AND A RIBBON

FIELD OF THE INVENTION

The present invention relates to a paper bail device for driving a paper bail to be used for holding a sheet of paper in a printer or the like.

BACKGROUND OF THE INVENTION

In an impact printer or the like, the paper is fed while being held on the platen by a paper bail so that the paper may be presented for excellent printing without floating over the platen and fed in a desired direction.

When the paper is to be set around the platen, the paper bail has to be moved away from the platen so that it does not obstruct the paper setting.

In the known prior art, the operation of bringing the paper bail into and out of contact with the platen was accomplished by: a first method of manually moving the paper bail; a second method of moving the paper bail by actuating a carrier and using a link mechanism; and a third method of moving the paper bail by a special solenoid and motor.

According to the first method of the aforementioned prior art, the working for the paper setting may be troublesome. The second method is accompanied by a problem in noise and durability because the carrier is brought into direct abutment against the link. The third method is also accompanied by a problem in its high cost and large space requirements because it requires the special solenoid and motor.

SUMMARY OF THE INVENTION

An object of the present invention is to provide a device which is able to bring a paper bail automatically into and out of contact with a platen without requiring a large amount of space and raising the cost by making use of the power of a ribbon motor.

In order to achieve the above-specified object, a paper bail according to the present invention comprises: a ribbon drive gear adapted to be driven by a reversible motor; a ribbon drive shaft coupled to the ribbon drive gear through a one-way clutch; a paper bail support lever hinged to a printer body and supporting a paper bail rotatably for bringing the paper bail into and out of contact with a platen; and a paper bail drive means actuated by the power of the motor for driving the paper bail support lever to bring the paper bail into and out of contact with the platen.

According to the paper bail drive device of the present invention, the paper bail can be brought into and out of contact with the platen by the power of the ribbon motor, and the ink ribbon can also be driven by the power of the ribbon motor through the ribbon drive gear, the one-way clutch and the ribbon drive shaft.

DESCRIPTION OF THE PREFERRED EMBODIMENTS

The present invention will now be described in connection with one of its embodiments with references to the accompanying drawings.

Figure 1:
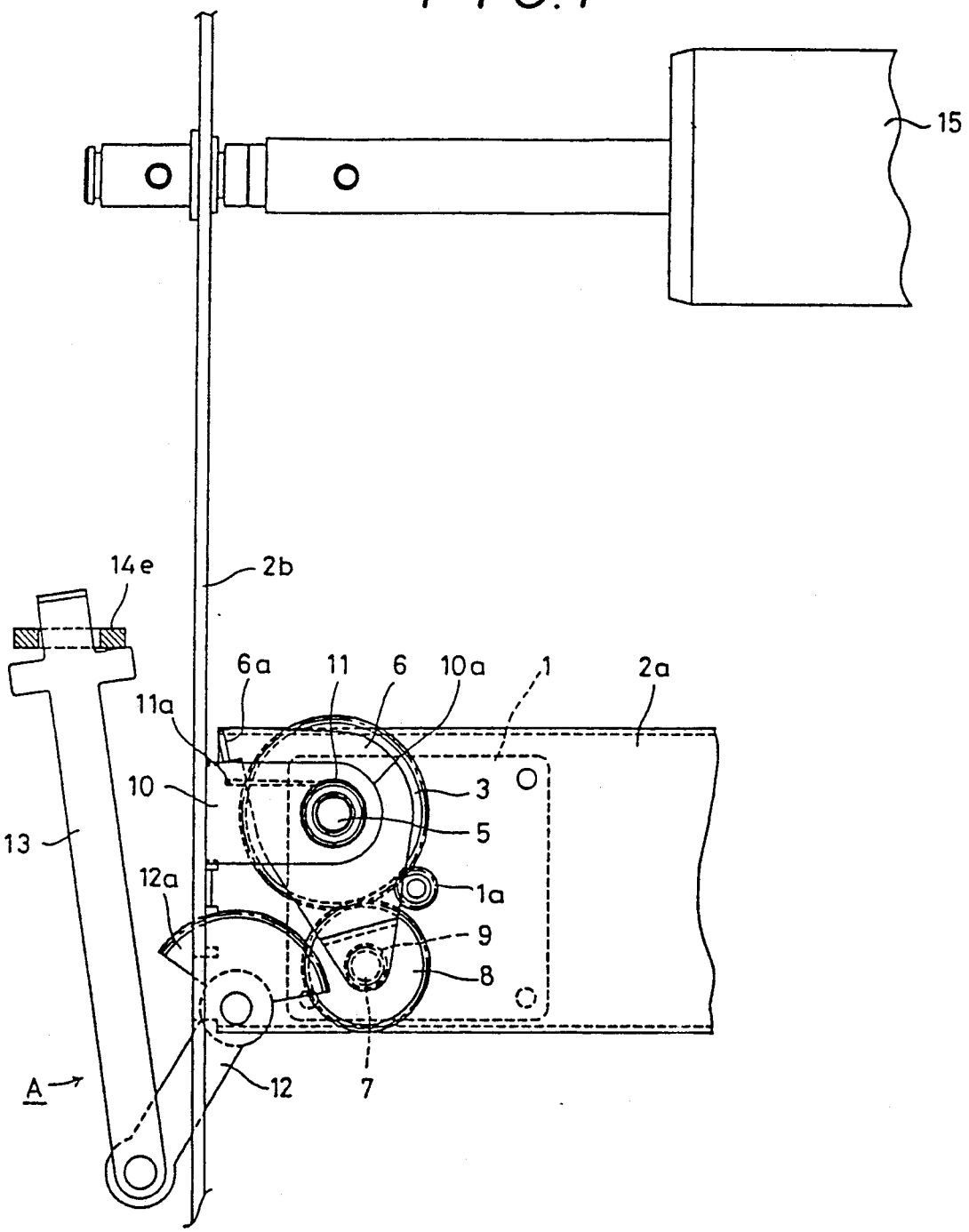
FIG. 1 is a plan view showing the state in which a paper bail is in abutment contact with the platen.

On a base plate 2*a* of a printer body, as shown in FIG. 1, there is mounted a (ribbon) motor 1 which has its pinion 1*a* protruding above the base plate 2*a*.

Figure 3:
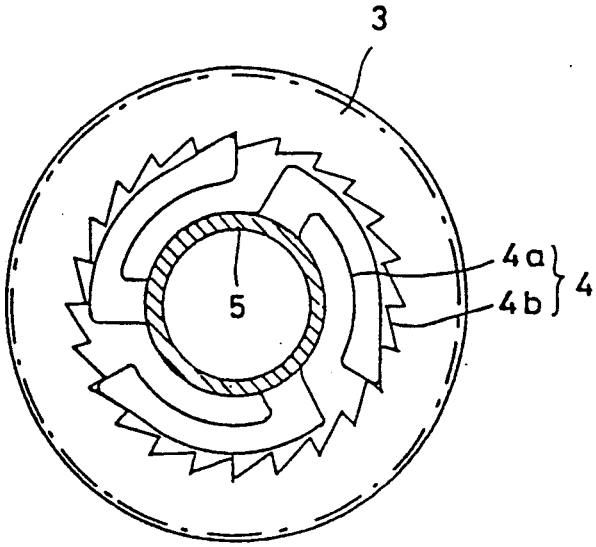
FIG. 3 is an enlarged plan view showing the one-way clutch.

The base plate 2*a* is equipped thereon with a ribbon drive gear 3 meshing with the pinion 1*a*. The ribbon drive gear 3 is coupled to a ribbon drive shaft 5 through a later-described one-way clutch 4. As seen from FIG. 3, more specifically, ratchet arms 4*a* are formed on a lower portion of the ribbon drive shaft 5, and the ribbon drive gear 3 is formed therein with retaining teeth 4*b* for retaining the drive gear 3.

Figure 4:
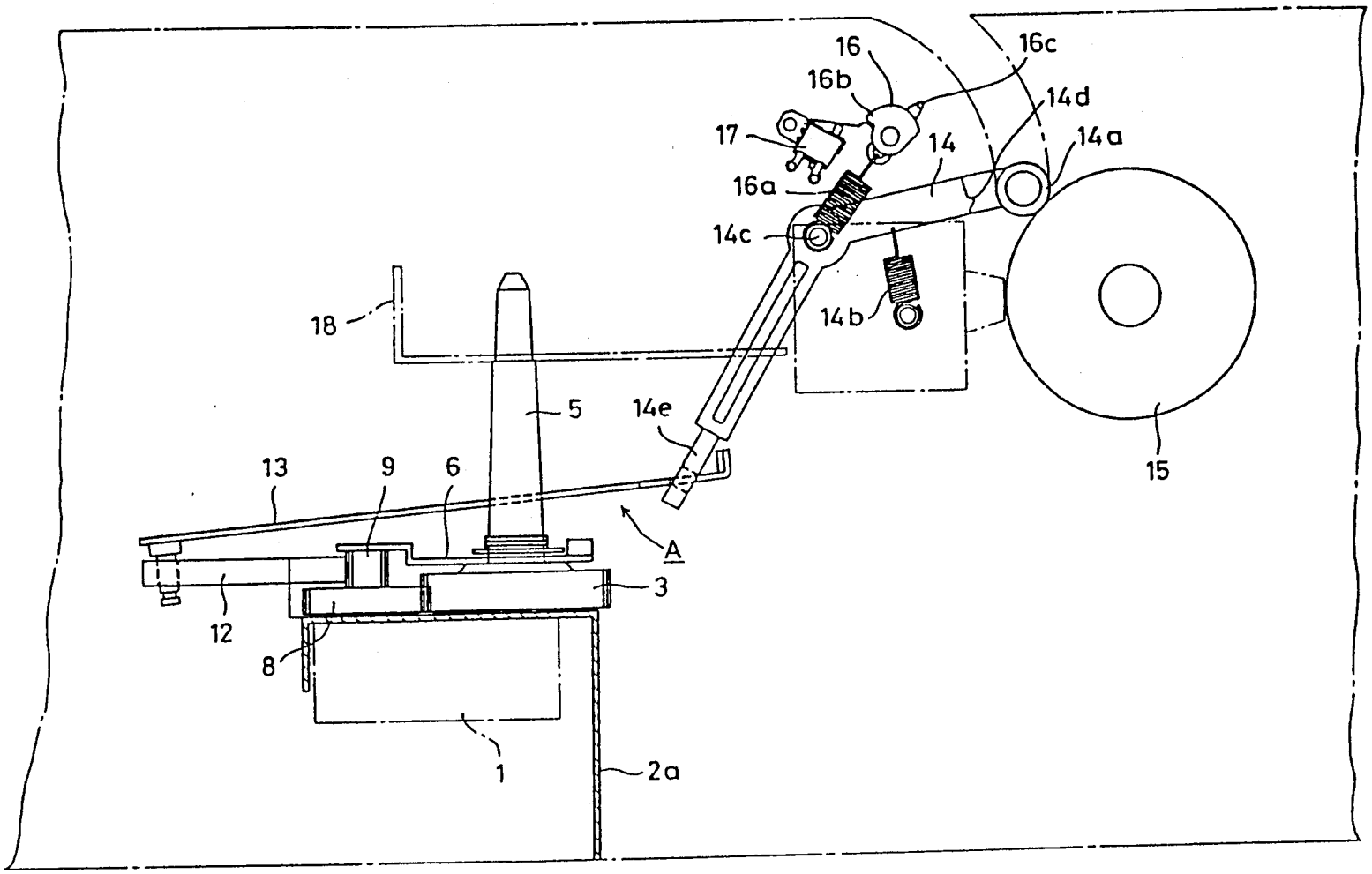
FIG. 4 is a side elevation showing the state in which the paper bail is in abutment against the platen.

As shown in FIG. 4, the printer body is equipped with a paper bail support lever 14 which supports a paper bail 14*a* rotatably and in a manner to bring it into and out of contact with a platen 15.

There is provided paper bail drive means A for driving the paper bail support lever 14 to bring the aforementioned paper bail 14*a* into and out of contact with the aforementioned platen 15. This paper bail drive means A is constructed in this embodiment in the following manner.

As shown in FIG. 1, more specifically, the ribbon drive gear 3 is equipped with a rotatable support plate 6. T the back of one end portion of the support plate 6, there is fixed a shaft 7, on which an intermediate gear 8 and a paper bail drive gear 9 are rotatably fitted together. The ribbon drive gear 3 is in meshing engagement with the intermediate gear 8.

The support plate 6 has its other end portion bent upward. The printer body has its base plate 2*b* equipped with a support plate holder 10 which has its one end portion 10*a* disposed over the support plate 6 to prevent the ribbon drive gear 3, the intermediate gear 8 and the support plate 6 from coming out.

Figure 2:
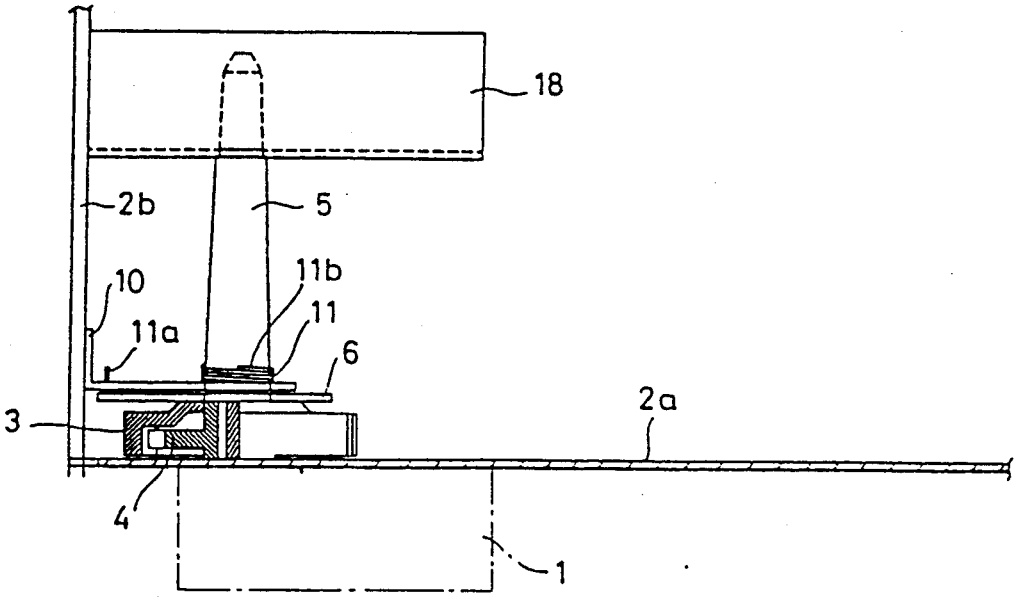
FIG. 2 is a front elevation thereof.

On the back of the support plate holder 10, as shown in FIG. 2, there is retained one end portion 11*a* of a one-way spring 11, which is wound counter-clockwise on the ribbon drive shaft 5 and has its other end 11*b* retained on the ribbon drive shaft 5.

With the structure thus far described, if the ribbon motor 1 rotates clockwise, the intermediate gear B receives a clockwise rotating force through the ribbon drive gear 3 such that the support plate 6 receives a counter-clockwise rotational moment around the ribbon drive shaft 5. If the ribbon motor 1 rotates counter-clockwise, the support plate 6 likewise receives a clockwise rotational moment.

On the base plate 2*a*, there is rotatably mounted a plate (i.e., a first member) 12 fixed to a rotatable gear 12*a*, which can come into and out of meshing engagement with the paper bail drive gear 9 when the support plate 6 is moved by the rotational moment resulting from the rotation of the aforementioned ribbon motor 1. A plate (i.e., a second member) 13 is hinged to the plate 12.

As seen in FIG. 4, the paper bail support plate 14 has its lower portion 14*e* extended to engage with the leading end of the plate 13. Between the paper bail support lever 14 and the body, there is disposed a paper holding spring (i.e., urging means) 14b for giving a paper bail 14a an elastic force directed toward the platen 15 so that the paper bail 14a abuts against the platen 15 in an initial state.

The printer body is equipped with a rotatable stopper 16. Between the stopper 16 and the pivot pin 14c of the paper bail support lever 14, there is provided a return spring 16a such that the hooked portion of the return spring 16a on the stopper 16, the center of rotation of the stopper 16, and the center of rotation of the paper bail support lever 14 are in line.

The stopper 16 is equipped with a push portion 16b for pushing a later-described microswitch (or switch) 17, and a pin 16c for engagement with an engaging portion 14d of the paper bail support plate 14. The microswitch 17 is disposed in the vicinity of the stopper 16 so as to detect the position of the paper bail support lever 14. The microswitch 17 can be turned on or off by the rotational displacement of the stopper 16.

Next, the operation will be described as follows.

First of all, a description will be made of the case in which the paper bail 14a is moved away from the platen 15 so that the paper can run on the platen 15.

Figure 5:
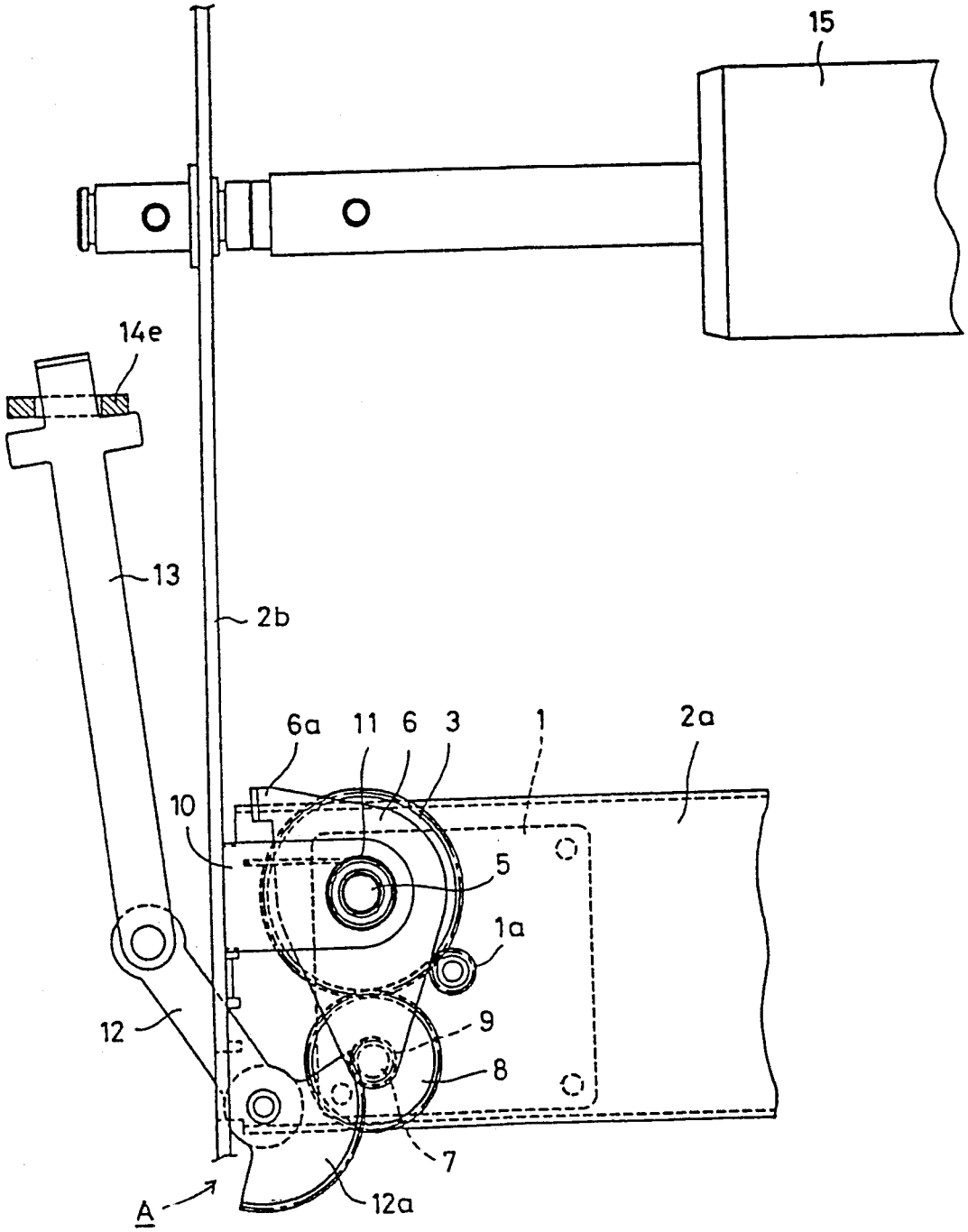
FIG. 5 is a plan view showing the state in which the paper bail is spaced from the platen.

If the ribbon motor 1 rotates counter-clockwise, as shown in FIG. 5, the ribbon drive gear 3 rotates clockwise whereas the intermediate gear 8 and the paper bail drive gear 9 rotate counter-clockwise. At this time, the support plate 6 is moved by the clockwise rotational moment to bring the paper bail drive gear 9 into meshing engagement with the gear 12a.

At this time, the ribbon drive shaft 5 is willing to rotate clockwise together with the ribbon drive gear 3. In this direction, however, the one-way spring 11 is wound on the ribbon drive shaft 5 so that the ribbon drive shaft 5 becomes irrotational. While the ribbon drive shaft 5 is thus halted by the one-way clutch 4, the retaining teeth 4b rotate in sliding contact with the ratchet arms 4a so that the ribbon drive gear 3 continues its rotation.

Figure 6:
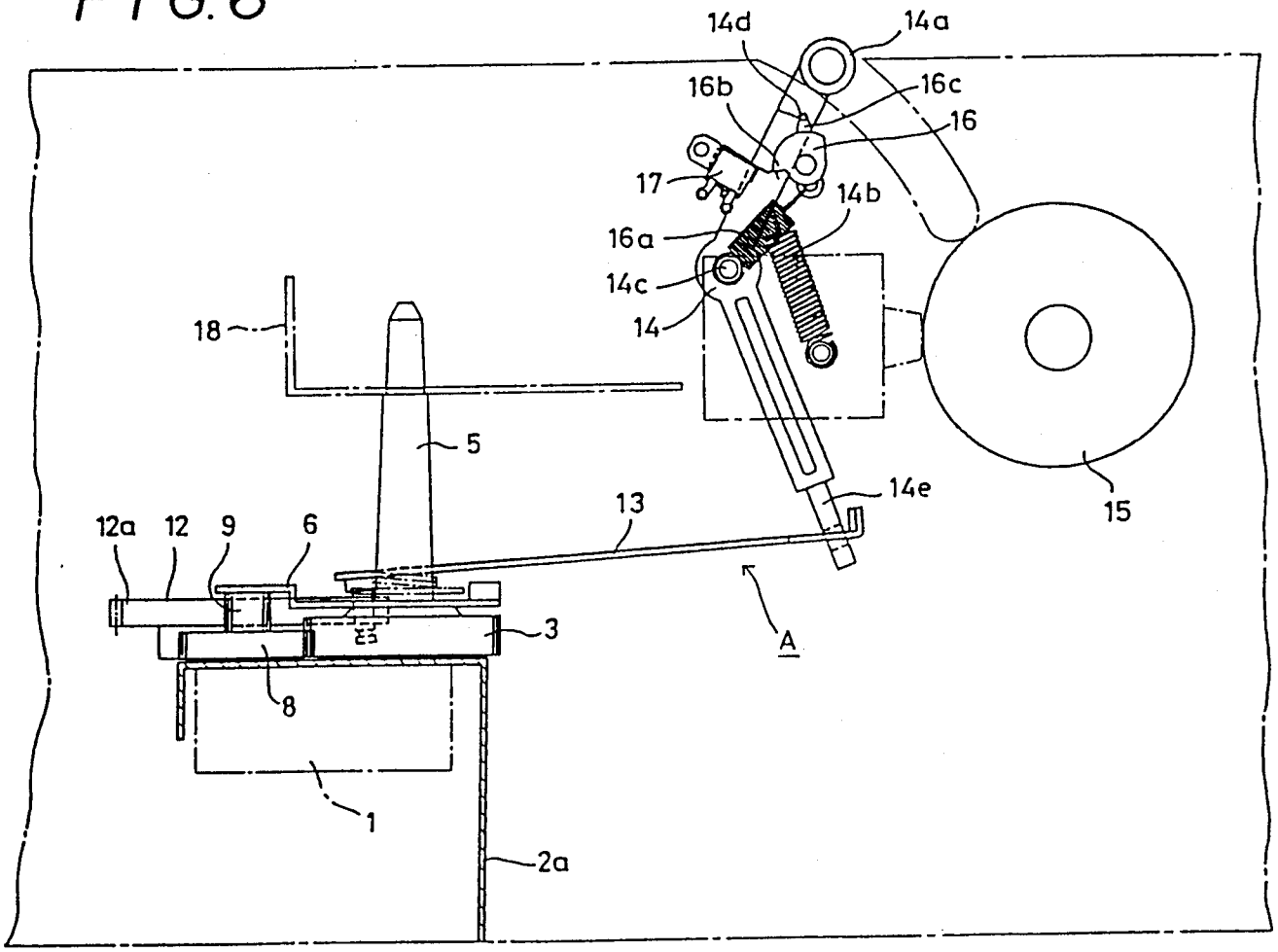
FIG. 6 is a side elevation thereof.

The gear 12a is rotated clockwise if it comes into meshing engagement with the paper bail drive gear 9. As a result, as shown in FIG. 6, the plate 12 moves the plate 13 toward the platen 15. As a result, the paper bail support lever 14 has its extension 14e pushed toward the platen 15 so that it is rotated counter-clockwise against the force of the paper holding spring 14b to bring the paper bail 14a out of contact with the platen 15.

The paper bail support lever 14 continues its rotation so that its retaining portion 14d comes into engagement with the pin 16c of the stopper 16. As a result, the stopper 16 rotates counter-clockwise against the force of the return spring 16a. The push portion 16b of the stopper 16 pushes the microswitch 17 so that the CPU of the printer detects that the paper bail 14a has come to a first predetermined position.

If the ribbon motor 1 is then stopped at a certain timing, the paper bail support lever 14 is fixed by the engagement between the engaging portion 14d and the pin 16c of the stopper 16.

In this state, the paper is fed to run on the platen 15. Since, at this time, the paper bail 14a is out of abutment against the platen 15, the paper can be easily placed to run on the platen 15.

Next, the operation of bringing the paper bail 14a into abutment against the platen 15 will be described as follows.

If the ribbon motor 1 is further rotated counter-clockwise, the paper bail support lever 14 is turned counter-clockwise to disengage the engagement portion 14d from the pin 16c. As a result, the stopper 16 is returned to its initial state by the force of the return spring 16a so that the push portion 16b is released from the microswitch 17. Then, the microswitch 17 is turned off so that the CPU of the printer detects that the paper bail 14a has come to a second predetermined position. If the ribbon motor i is then rotated clockwise at a timing, as shown in FIG. 1, the support plate 6 is moved by the clockwise rotational moment so that the paper bail drive gear 9 comes out of meshing engagement with the gear 12a. As a result, as shown in FIG. 4, the paper bail support lever 14 is turned clockwise by the force of the paper holding spring 14b so that the paper bail 14a comes into abutment against the platen 15. Thus, the setting of the printer with the paper is completed.

At this time, clockwise rotational moment is applied to the support plate 6 through the gear 12a by the force of the paper holding spring 14b, as shown in FIG. 5. In this direction, the paper bail device gear 9 is in meshing engagement with the gear 12a. If, therefore, the clockwise rotation of the ribbon motor 1 is speeded up, the influence of the aforementioned force of the paper holding spring 14b are so weakened that the paper bail drive gear 9 quickly leaves the gear 12a whereas the paper bail 14a quickly abuts against the platen 15.

If the clockwise rotation of the ribbon motor 1 is slowed down, the aforementioned influence of the force of the paper holding spring 14b is strengthened so that the paper bail 14a slowly comes into abutment against the platen 15. Thus, the speed for bringing the paper bail 14a into abutment against the platen 15 can be adjusted by the clockwise rotational speed of the ribbon motor 1.

Next, the following description is directed to the case, in which a ribbon cassette is to be driven. First of all, the not-shown ribbon cassette is attached to a ribbon cassette mounting plate 18, as shown in FIG. 2. If the ribbon motor 1 is rotated clockwise, the support plate 6 is turned around the ribbon drive shaft 5 by the counter-clockwise rotational moment. The support plate 6 has at its other end a bent portion 6a abutting against the support plate holder 10 so that it is not rotated any more. As a result, it is possible to prevent the intermediate gear 8 and the pinion 1a of the ribbon motor 1 from meshing with each other.

At this time, the ribbon drive gear 3 rotates counter-clockwise to loosen the one-way spring 11 with respect to the ribbon drive shaft 5. Then, the ribbon drive shaft 5 is rotated counter-clockwise to feed the ribbon of the cassette connected thereto, because the retaining teeth 4b of the ribbon drive gear 3 push the ratchet arms 4a.

The paper bail drive device is not limited to the embodiment thus far described but may be modified such that the ribbon motor drives the ribbon cassette if it rotates counter-clockwise, whereas the paper bail moves away from the platen if the ribbon motor rotates clockwise. Moreover, the paper bail drive device should not have its drive limited to the ribbon drive gear but may be any other drive which can be driven by the ribbon motor. Still moreover, the one-way spring is not always indispensable. Furthermore, the urging means and the return spring should not have their shapes limited to those of the present embodiment. Nor should the switch be limited to the microswitch.

According to the present invention, the paper bail drive gear and the gear having the first member fixed thereto are brought into and out of meshing engagement with each other by the rotation of the support plate in dependence upon the direction of rotation of the ribbon motor so that both the ribbon cassette and the paper bail can be driven through the one-way clutch by the single ribbon motor.

As a result, the paper bail can be automatically driven in a simple operation without requiring any direct abutment of the carrier against the link, without any problem in noise and durability and without any special solenoid or the like and its attendant space requirements and cost.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What I claim is:

1. A paper bail device operable with a platen comprising:

a reversible motor;

a ribbon drive gear operable to be driven by said reversible motor;

a one-way clutch;

a ribbon drive shaft coupled to said ribbon drive gear through a one-way clutch;

a paper bail;

a paper bail support lever supporting said paper bail rotatably for bringing said paper bail into and out of contact with said platen; and a paper bail driven means actuated by the power of said motor for driving said paper bail support lever to effect rotatable movement of said paper bail into and out of contact with said platen.

2. A paper bail device as set forth in claim 1, wherein said paper bail drive means comprises:

an intermediate gear and a paper bail drive gear, said intermediate gear meshing with said ribbon drive gear, said paper bail drive gear being integrated with said intermediate gear;

a support plate rotatably borne on said ribbon drive shaft and supporting rotatably both said intermediate gear and said paper bail drive gear;

a rotatable gear adapted to be brought into and out of meshing engagement with said paper bail drive gear when said support plate is moved by the rotation of said motor;

a first member fixed to said rotatable gear;

an extension formed in the lower portion of said paper bail support level;

a second member hinged to said first member and engaged with said extension; and urging means for causing said paper bail support lever to urge said paper bail toward said platen;

whereby said paper bail comes out of contact with said platen through said first member, said second member and said extension when said paper bail drive gear is brought into meshing engagement with said rotatable gear by the movement of said support plate caused by the rotation of said motor in one direction, and said paper bail is urged to abut against said platen by said urging means when said paper bail drive gear is disengaged from said rotatable gear by movement of said support plate caused by the rotation of said motor in an opposite direction.

3. A paper bail device as set forth in claim 1, wherein said paper bail support lever has an engaging portion, and further comprises a rotatable stopper having a pin engagable with said engaging portion disposed in the vicinity of said paper bail support lever, and having a return spring for applying to said stopper an urging force to hold said stopper in an original position.

4. A paper bail device as set forth in claim 3, further comprising a switch operable to be turned on or off according to the rotational displacement of said stopper.

5. In a paper bail device for a machine having a platen comprising a paper bail, means for pivotally mounting said paper bail on said machine between a contacting position in which said paper bail contacts said platen and a separated position in which said paper bail is spaced from said platen, a reversible motor, and operable means operably disposed between said reversible motor and said paper bail such that rotation of said reversible motor in one direction affects pivoting of said paper bail into said contacting position and rotation of said reversible motor in an opposite direction effects pivoting of said paper bail into said separated position, said operable means comprising a ribbon drive member operable to be driven by said motor, a ribbon driven member for driving a ribbon means, and a one-way clutch operably disposed between said ribbon drive member and said ribbon driven member.

6. In a paper bail device according to claim 5, comprising means for operating said one-way clutch to cause said ribbon drive member to drive said ribbon driven member when said motor rotates in said one direction and to permit said ribbon drive member to rotate independently of said ribbon driven member when said motor rotates in said opposite direction.

7. In a paper bail device according to claim 6, wherein said operable means comprises prevention means which prevents said ribbon driven member from rotating when said motor rotates in said opposite direction.

8. In a paper bail device according to claim 5, further comprising a ribbon cassette, wherein said machine mounts said ribbon cassette, said ribbon driven member driving said ribbon cassette when said motor rotates in said one direction.

9. In a paper bail device according to claim 5, wherein said operable means comprises an intermediate gear meshing with said ribbon drive member, a support plate rotatably supported on said ribbon driven member and supporting said intermediate gear and a paper bail drive gear fixed to said intermediate gear, said ribbon driven member having an axis of rotation, a paper bail driven gear, said support plate being moveable about said axis between an engaged position in which said paper bail drive gear meshes with said paper bail driven gear and a non-engaged position in which said paper bail drive gear is disengaged from said paper bail driven gear, said ribbon drive member meshing with said intermediate gear to move said support plate to said disengaged position when said motor rotates in said one direction and to said engaged position when said motor rotates in said opposition direction.

10. In a paper bail device according to claim 9, wherein said operable means further comprises a first member fixed to said paper bail driven gear and a second member operably connected between said first member and said paper bail, urging means urging said paper bail towards said contacting position, said first and second members being operable to permit said urging means to urge said paper bail into said contacting position when said support plate is in said disengaged position, said first and second members being operable to move said paper bail to said separated position when said support plate is in said engaged position.

11. In a paper bail device according to claim 5, wherein said operable means comprises a rotatably mounted stopper means rotatable between an actuated and an unactuated position, said paper bail being operable to rotate said stopper means into said actuated position when said paper bail is moved into said separated position, said stopper means being in said unactuated position when said paper bail is in said contacting position.

12. In a paper bail device according to claim 5, comprising means for controlling the speed of said motor to control the speed of movement of said paper bail when said paper bail moves from said separated to said contacting position.

13. In a paper bail device for a machine having a platen comprising a paper bail, means for pivotally mounting said paper bail on said machine between a contacting position in which said paper bail contacts said platen and a separated position in which said paper bail is spaced from said platen, a reversible motor, and operable means operably disposed between said reversible motor and said paper bail such that rotation of said reversible motor in one direction effects pivoting of said paper bail into said contacting position and rotation of said reversible motor in an opposite direction effects pivoting of said paper bail into said separation position, said operable means comprising a rotatably mounted stopper means rotatable between an actuated and an unactuated position, said paper bail being operable to rotate said stopper means into said actuated position when said paper bail is moved into said separated position, said stopper means being in said unactuated position when said paper bail is in said contacting position, and further comprising switch means which is actuated by said stopper means when said stopper means moves to said actuated position.

14. In a paper bail device for a machine having a platen comprising a paper bail, means for pivotably mounting said paper bail on said machine between a contacting position in which said paper bail contacts said platen and a separated position in which said paper bail is spaced from said platen, a reversible motor, and operable means operably disposed between said reversible motor and said paper bail such that rotation of said reversible motor in one direction effects pivoting of said paper bail into said contacting position and rotation of said reversible motor in an opposite direction affects pivoting of said paper bail into said separated position, said operable means comprising a rotatably mounted stopper means rotatable between an actuated and an unactuated position, said paper bail being operable to rotate said stopper means into said actuated position when said paper bail is moved into said separated position, said stopper means being in said unactuated position when said paper bail is in said contacting position, said stopper means comprising biasing means biasing said stopper means toward said unactuated position.

15. In a paper bail device for a machine having a platen, comprising a paper bail moveable between a contacting position in which said paper bail contacts said platen and a separated position in which said bail is spaced from said platen, a ribbon means, a reversible drive motor for driving said ribbon means, and operable means operably disposed between said motor and said paper bail such that rotation of said motor in one direction effects pivoting of said paper bail into said contacting position and also effects driving of said ribbon means while rotation of said motor in an opposite direction effects pivoting of said paper bail into said separation position without driving said ribbon means, said operable means comprising a drive member, a driven member and a one-way clutch interposed between said drive member and said driven member, said driven member driving said ribbon means, said one-way clutch being operable to cause said drive member to driven said driven member when said motor rotates in said one direction, said one-way clutch being operable to permit said drive member to rotate independently of said driven member when said motor rotates in said opposite direction.

16. In a paper bail device according to claim 15, wherein said machine is a printer and said ribbon means is a ribbon cassette mounted on said printer.

* * * * *